US005701947A

United States Patent [19]

Bishenden

[11] Patent Number: 5,701,947

[45] Date of Patent: Dec. 30, 1997

[54] DIE CAST MOULD APPARATUS

[75] Inventor: Warren J. Bishenden, Newmarket, Canada

[73] Assignee: Exco Technologies, Ltd., Ontario, Canada

[21] Appl. No.: 551,495

[22] Filed: Nov. 1, 1995

[51] Int. Cl.[6] ..... B22D 17/26; B22D 33/04

[52] U.S. Cl. ..... 164/341; 164/340; 164/137; 164/302; 164/397

[58] Field of Search ..... 164/341, 340, 164/302, 397, 398, 399, 137

[56] References Cited

U.S. PATENT DOCUMENTS 5,429,175 7/1995 Thieman et al. ..... 164/341
5,533,564 7/1996 Alberola et al. ..... 164/341

OTHER PUBLICATIONS

Advertisement: "THT Breakthrough Technology Conventional Die Cast Machine", THT Presses Inc., Date Unknown.

*Primary Examiner*—Jack W. Lavinder
*Assistant Examiner*—I.-H. Lin
*Attorney, Agent, or Firm*—Keck, Mahin & Cate

[57] ABSTRACT

A die cast mould apparatus having a base for supporting a mould body partially defining a mould cavity. A mould body insert is insertable in the partially defined mould cavity and may be locked in this position to complete the mould cavity. The mould body insert is mounted on a retainer which is mounted in a channel, in a support extending from the base. The retainer may be locked to the support in the channel by way of interlocking wedges on the retainer and wedge receptors in the channel walls of the support, thereby locking the insert in the position to complete the mould cavity.

27 Claims, 5 Drawing Sheets

DIE CAST MOULD APPARATUS

FIELD OF THE INVENTION

This invention relates to a moulding apparatus, and preferably to a die cast moulding apparatus for forming moulded metal products.

BACKGROUND OF THE INVENTION

In the die casting process, hot molten metal, such as aluminum is injected into a mould shaped to form a die cast metal product. The mould is often formed by sliding one of two mould portions into abutment with the other to form a mould body having a mould cavity. Molten metal is injected into this cavity at high temperatures and pressures. Pressures typically exceed 10,000 p.s.i., resulting in forces in excess of 3000 tonnes force on the faces of the mould cavity. The molten metal is then allowed to cool and is released from the mould cavity by disengaging the two mould portions of the mould body.

In more complex arrangements, the mould cavity may require additional mould body inserts that move in and out to complete the mould cavity. Geometric features in the desired die cast metal product may require that these mould body inserts move in and out of the mould cavity at vectors having directions other than the direction of motion of the mould portions relative to each other.

Typically, the mould body insert is inserted into the mould body at an angle of 90° relative to the direction in which the sliding mould portion is moved. The body insert can then be held in place by an arm which extends from the sliding mould portion and moves behind the insert when the sliding portion is slid into place.

Because the insert is held in place by the sliding mould portion, the mould body insert cannot be inserted and be rigidly retained at oblique angles (ie. non 90° angles) to the sliding direction. Depending on the desired shape of the resulting product, insertion at other angles may be desirable. Moreover, an apparatus permitting such insertion provides for increased flexibility.

One arrangement addressing these goals utilizes an arm extending behind the insert and supporting it. The arm has an elbow joint and a piston of a hydraulic cylinder is connected to the elbow. By extending the piston, the arm is straightened and the mould body insert is slid forward sliding into place when the arm is ram rod straight. A difficulty with this arrangement is the elasticity along the length of the arm. The mould body insert thus moves incrementally when pressurized molten metal is injected introduced into the system.

The present invention attempts to overcome disadvantages of known systems.

SUMMARY OF THE INVENTION

In accordance with one aspect of the invention there is provided a mould apparatus comprising a base for supporting a mould body partially defining a mould cavity; a retainer for supporting a mould body insert in extending relationship therefrom; the mould body insert for association with the partially defined mould cavity, to further define the mould cavity; the retainer slidably mounted on a support for movement between a first position whereat the insert is substantially removed from the partially defined mould cavity and a second position whereat the insert is within the partially defined mould cavity to further define the mould cavity; interlocking means comprising a first one of a wedge receptor in the retainer and a slidable wedge supported by the retainer, and a first complementary one of a wedge receptor in the support and a slidable wedge supported by the support; and camming means interconnecting the retainer and the first wedge for extending the first wedge toward and into the first wedge receptor as the retainer is moved from the first position to the second position such that the first wedge engages the first wedge receptor when the retainer is in the second position to lock the retainer in the second position.

In accordance with another aspect of the invention there is provided a mould apparatus comprising: a first part for supporting a first mould body portion; a second part for supporting a second mould body portion the second part moveable toward the first part along a first path such that the first and second mould body portions form a mould body partially defining a mould cavity; a retainer for supporting a mould body insert in extending relationship therefrom; the mould body insert for association with the partially defined mould cavity, for further define the mould cavity; the retainer slidably mounted on a support for movement along a second path between a first position whereat the insert is substantially removed from the partially defined mould cavity and a second position whereat the insert is within the partially defined mould cavity to further define the mould cavity; interlocking means comprising a first one of a wedge receptor in the retainer and a slidable wedge supported by the retainer, and a first complementary one of a wedge receptor in the support and a slidable wedge supported by the support; and camming means interconnecting the retainer and the first wedge for extending the first wedge toward and into the first wedge receptor as the retainer is moved from the first position to the second position such that the first wedge engages the first wedge receptor when the retainer is in the second position to lock the retainer in the second position.

In accordance with another aspect of the invention there is provided a die cast mould apparatus comprising: a base for supporting a mould body, the mould body partially defining a mould cavity; a mould body insert to further define the mould cavity when the mould body insert is inserted in a partially defined mould cavity and locked in a position, the mould body insert mounted on a retainer; a support extending from the base defining a channel wherein the retainer is locked to the support in the channel by way of interlocking wedges and wedge receptors when the retainer is moved in the channel to further define the mould cavity; and wherein one of the wedges and wedge receptors is on the retainer, and the other one of the wedges and wedge receptors is on walls of the channel.

BRIEF DESCRIPTION OF THE DRAWINGS

In drawings which illustrate an example of an embodiment of the invention.

DETAILED DESCRIPTION OF THE PREFERRED EMBODIMENTS

Figure 1A:
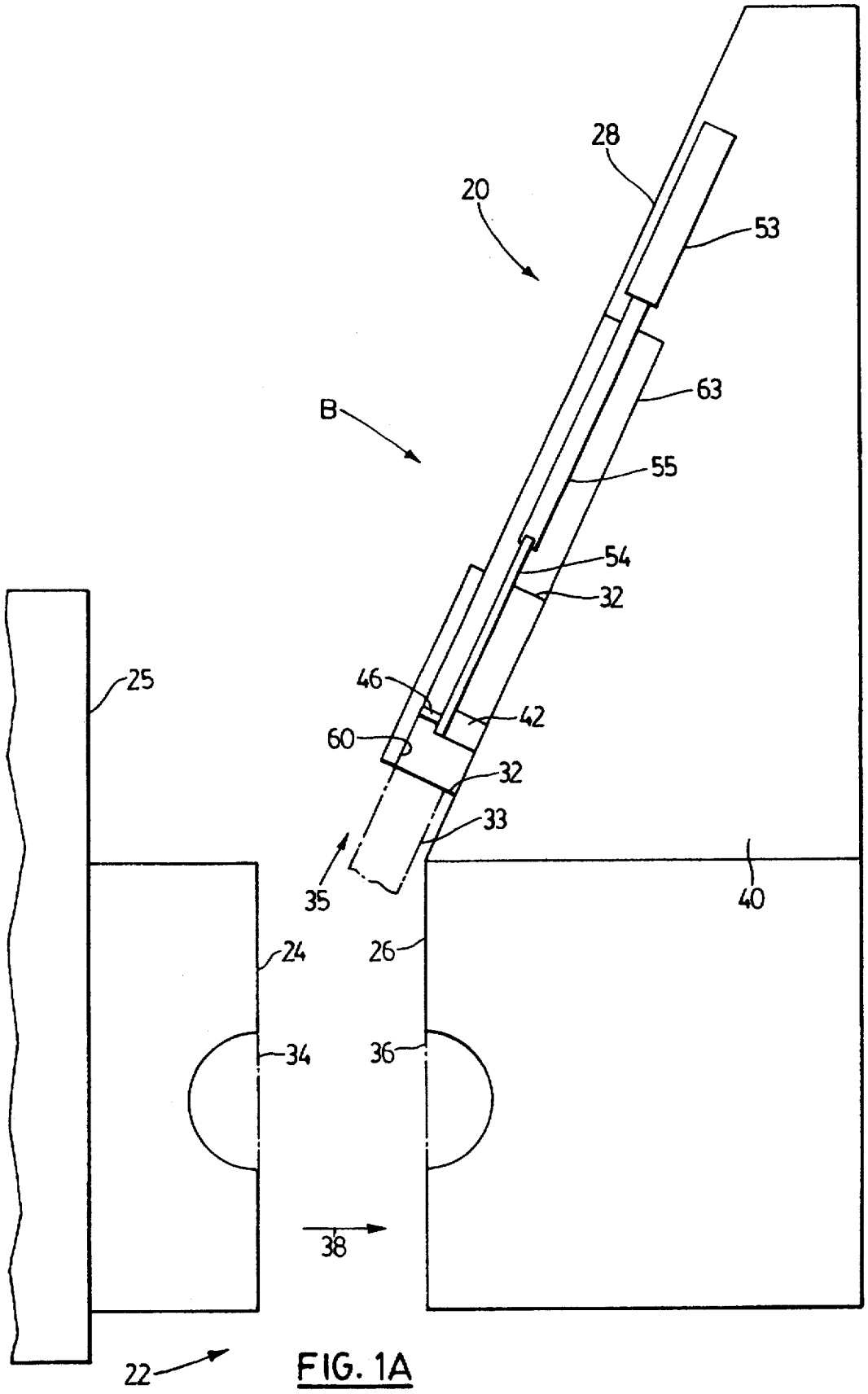
FIG. 1A is a simplified, and partially cross sectional side view of a die cat mould apparatus incorporating a mould body retainer made in accordance with this invention.
Figure 1B:
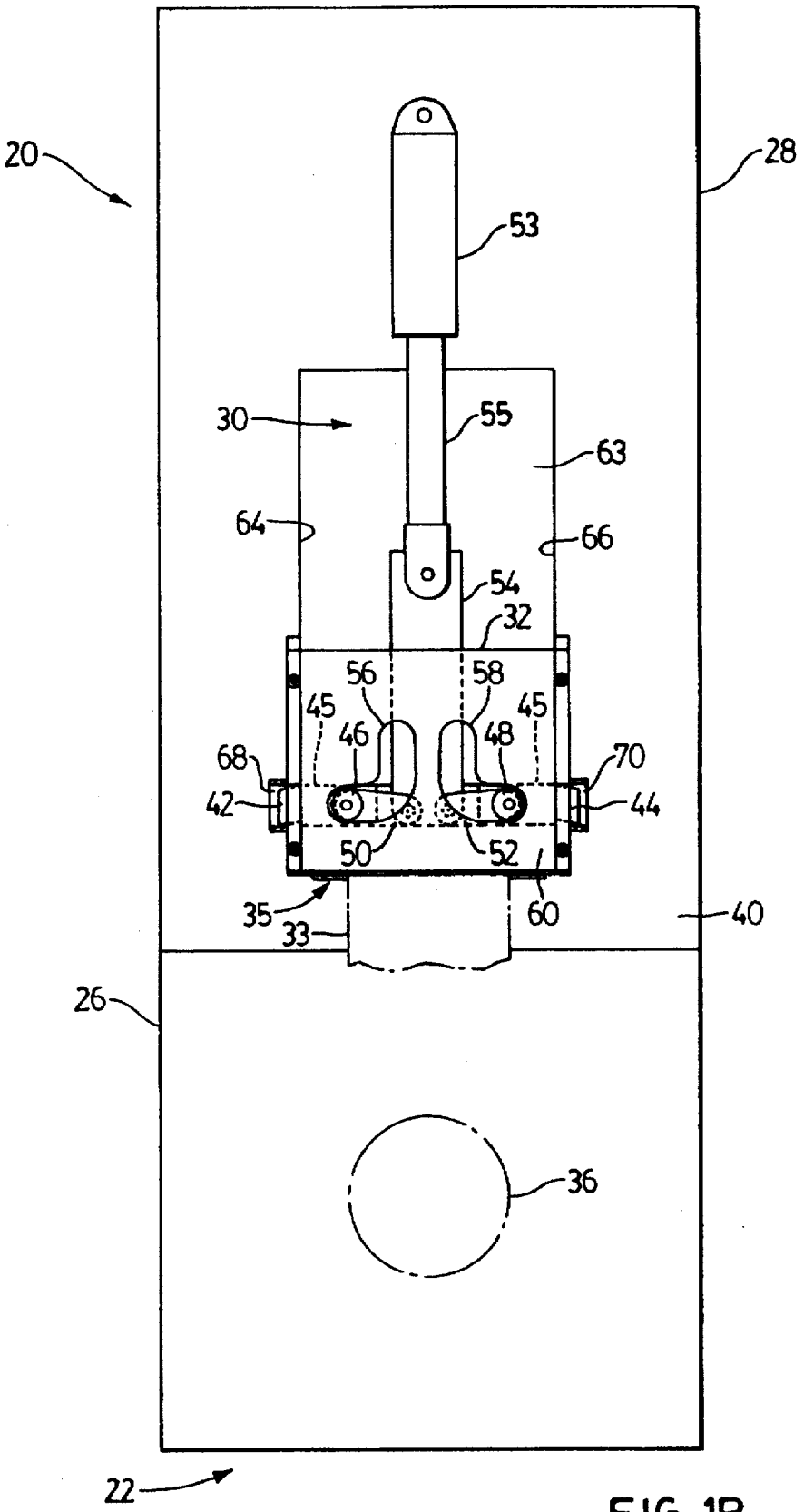
FIG. 1B is a simplified and partially cross sectional view of the die cast mould apparatus of FIG. 1A in the direction of arrow B.

FIGS. 1A and 1B illustrates a die cast mould apparatus 20, having a base 22 with a fixed side 40 supporting a mould portion 26 and an hydraulic press 25 to which a mould portion 24 is mounted. Mould portions 24 and 26 define mould cavity portions 34 and 36, respectively.

Fixed side 40 has a support section 28 with a channel 30 having opening 35. Channel 30 extends at an angle to sliding direction 38 of hydraulic press 25. Slidably mounted within channel 30 is a mould body insert retainer 32 for supporting mould cavity insert 33. Insert 33 may be bolted to retainer 32. Thus different inserts may be used with different mould arrangements.

Figure 2:
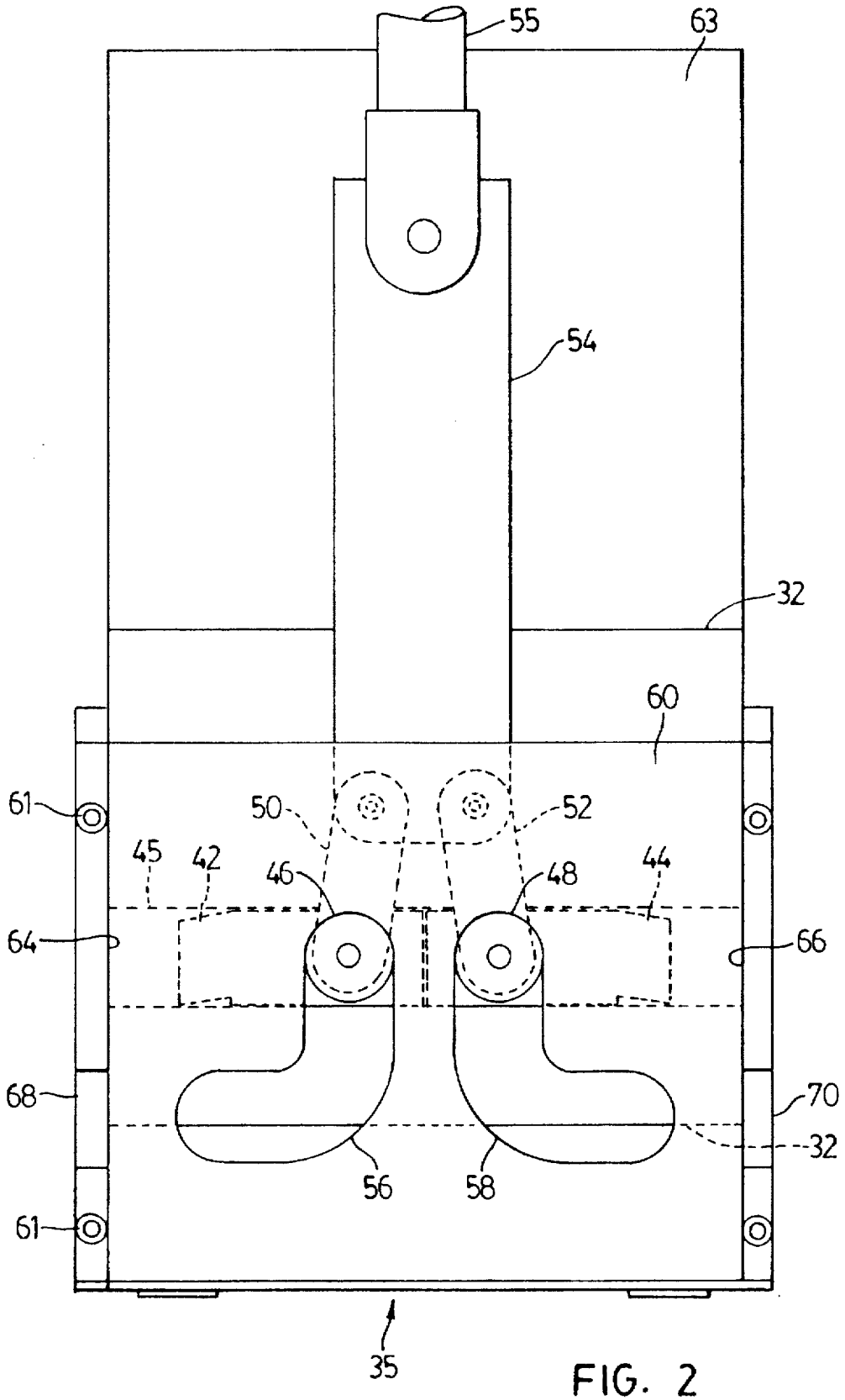
FIG. 2, is a top view of the mould body insert retainer of FIGS. 1A and 1B mounted within a channel of a die cast mould apparatus.
Figure 3:
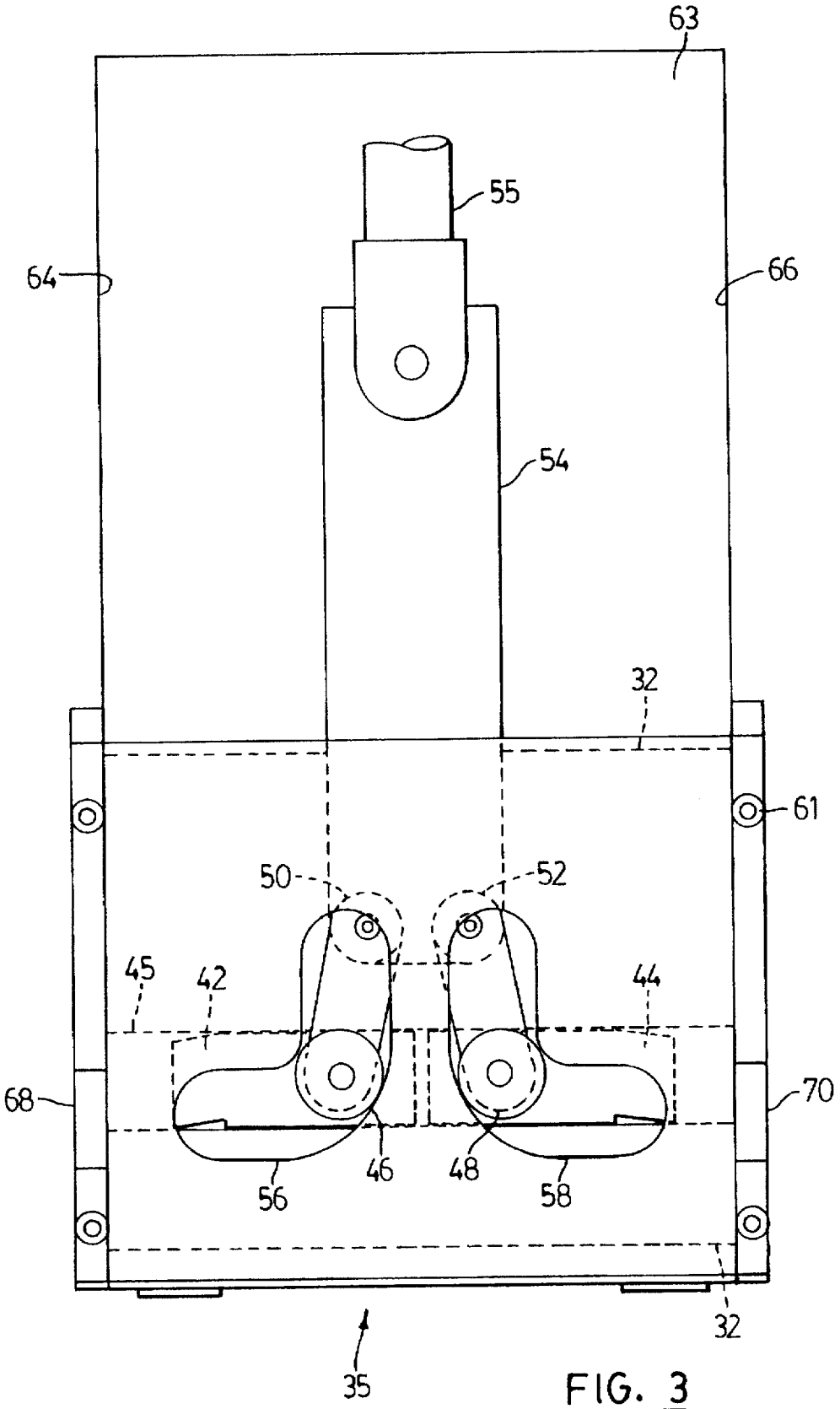
FIG. 3, is a top view of the retainer, shown in a partially extended position.
Figure 4:
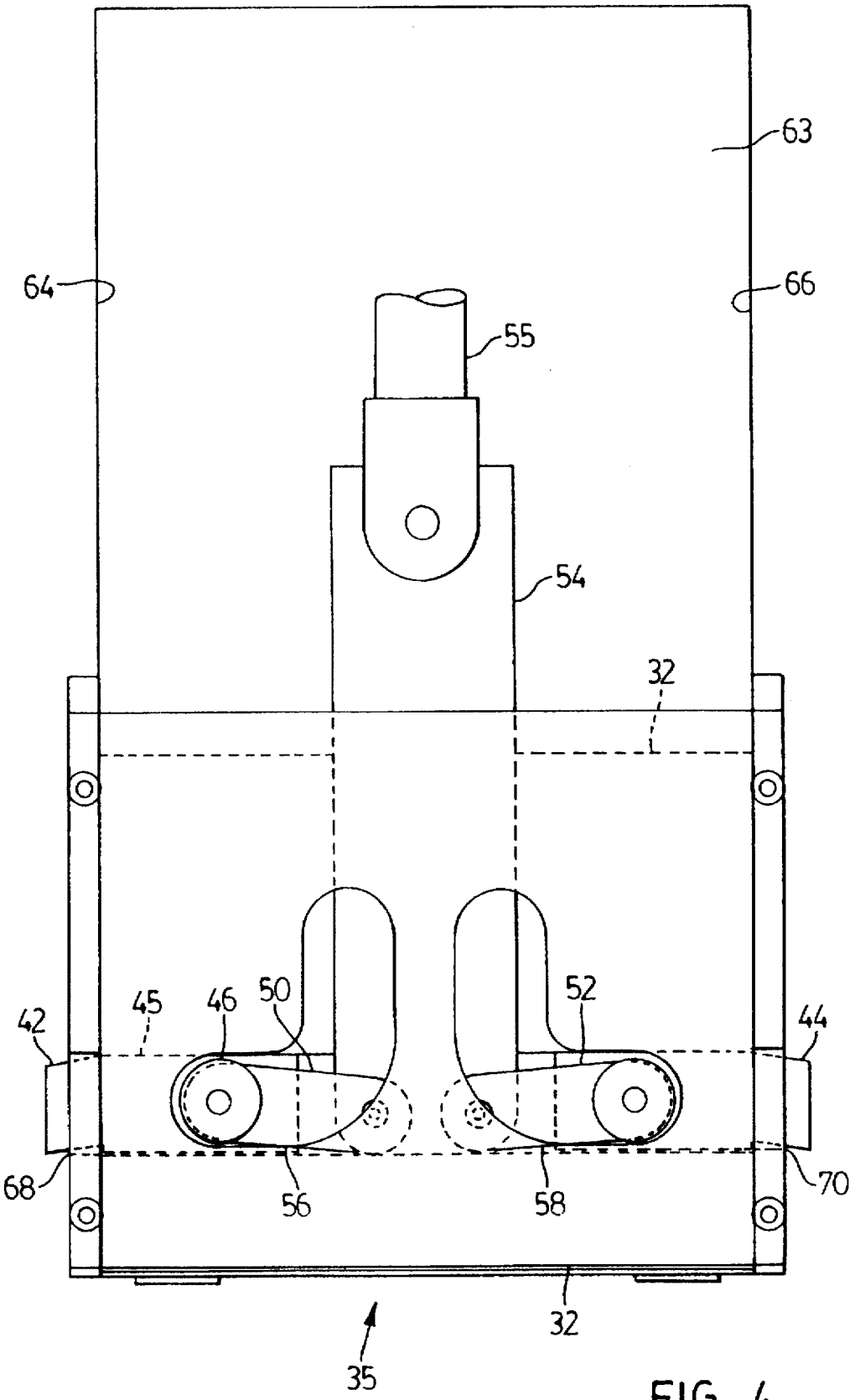
FIG. 4, is a top view of the retainer shown in an extended and locked position.

As best seen in FIGS. 2–4, retainer 32 further comprises two wedges 42 and 44 mounted within a directing passage 45. As seen in FIG. 4, wedges 42 and 44 have an extended position, in which they extend from the edges of retainer 32. Rotatably attached to each of wedges 42 and 44 is a cam roller 46 and 48, respectively. A link arm 50, 52 is rotatably attached at a first end to rollers 46, 48. The opposite end of link arm 50, 52 is rotatably attached to linking rod 54. Linking rod 54, extends from piston 55 of hydraulic cylinder 53.

Cam rollers 46 and 48 are mounted in cam slots 56 and 58, respectively. Cam slots 56 and 58 have a width slightly greater than the diameter of rollers 46 and 48. They are formed within a top wall 60 of channel 30. Cam slots 56 and 58 are generally L-shaped, with a rounded corner which permits travel of rollers 46 and 48. Wall 60 is mounted by bolts 61 to channel walls 64,66 of support section 28. Cam slots 56, 58 may be hand machined into wall 60, prior to the assembly of support 28. A wall 63, opposite wall 60 supports retainer 32, and maintains cam rollers 46, 48 in slots 56, 58.

Formed within channel walls 64 and 66 of support 28 are wedge receptors 68 and 70. Wedge receptors 68 and 70 are shaped to receive and engage wedges 42 and 44. These receptors may be hand machined into support 28, prior to assembly.

The channel walls 64,66 wedges 42,44 and wedge receptors 68, 70 are oriented such that wedges 42,44 slide in a direction perpendicular to sliding direction 38.

All components forming the mould casting apparatus are typically made of alloy steel, in order to withstand the large forces experienced by them when in use.

In operation, the mould casting apparatus may be used as follows. Beginning from a retracted position (FIG. 2), hydraulic cylinder 53 is extended. This moves linking rod 54 and link arms 50 and 52 forward. Since link arms 50, 52 are connected to the cam rollers 46, 48, rollers 46, 48 move along cam slots 56 and 58. However, the rollers are connected to retainer 32 via wedges 42, 44 so that the retainer 32 is slid along channel 30 toward opening 35. Moving retainer 32 toward opening 35 moves mould body insert 33 toward the top of the mould body formed by mould portions 24 and 26. An opening (not shown) is formed in the mould body and leads to the partially completed mould cavity formed by cavity portions 34 and 36. As retainer 32 is slid further toward opening 35, insert 33 penetrates the opening to the cavity, until insert 33 is ultimately seated within the mould body created by portion 26 to complete part of the mould cavity.

As retainer 32 moves toward opening 35, cam rollers 46, 48 are guided by cam slots 56 to cause wedges 42 and 44 to travel outwardly along directing passage 45 toward the edges of the retainer 32. As retainer 32 approaches its locked position, wedges 42 and 44 align with, and enter, wedge receptors 68 and 70. Retainer 32 is thus locked in place (FIG. 4) by the interlocking engagement of the wedges in the receptors 68 and 70. In this position, mould body insert 33 (FIG. 1) will be seated and locked within the mould body in order to complete the mould cavity.

Hydraulic press 25 is activated to push mould body portion 24 into abutment with mould body portion 26 to form a mould body.

At this point, molten metal is injected into the completed mould cavity at high pressures which may exceed 10,000 p.s.i. As the metal is injected at high pressure, mould body portions 24 and 26 are maintained in position by hydraulic press 25 (and any secondary lock). Mould body insert 33 is maintained in position by retainer 32. Support 28 resists the forces on insert 33 and retainer 32. More particularly, the forces are resisted through wedges 42 and 44 which are seated in wedge receptors 68 and 70 of the support. A small retaining force is also provided through the hydraulic cylinder 55 via link rod 54 and link arms 50 and 52.

Once the molten metal has been injected, it is allowed to cool. Hydraulic press 25 is released to disengage mould body portion 24 from mould portion 26 and a moulded metal product is released from the mould body. Thereafter, piston 55 of hydraulic cylinder 53 is retracted, thereby pulling linking rod 54 away from opening 35. The link arms 50 and 52 being connected to rod 54, pull cam rollers 50, 52 along cam slots 56 and 58. This results in wedges 42 and 44 being retracted from wedge receptors 68 and 70. Retainer 32 and insert 33 are therefore released from their previously locked positions. Insert 33, may then be removed from the mould body as retainer 32 is further retracted.

Mould cast apparatus 20 may then be reused for form another moulded product.

It will be understood by a person skilled in the art that various modifications to this preferred embodiment are possible. For example, the mould body need not be formed of only two mould portions, but may be formed by an arbitrary number of portions and these mould portions may be attached to either the fixed or moving portions of the mould or hydraulic press. Additionally, with appropriate linkages, the wedges may extend from walls 64, 66 of support 28, while retainer 32 may comprise the wedge receptors. Similarly, the wedge and wedge receptor arrangement could be replaced with a bolting arrangement in which bolts slide through walls 60, 63 of the support and through retainer 32 to lock retainer 32 and insert 33 in place.

The retainer 32 may optionally be housed in its own self-contained housing, having top, bottom, and sides with appropriate openings for allowing the wedges to extend. Such a housing could then be fixedly mounted to support 28.

Additionally, persons skilled in the art will realize that use of the invention need not be limited to die cast moulding, but could easily extend to other analogous injection moulding techniques, such as plastic injection moulding.

Various other changes, alterations, and modifications, of the above preferred embodiment are possible without departing from the scope of the invention which is defined by the claims.

I claim:

1. A mould apparatus comprising:

a base for supporting a mould body partially defining a mould cavity;

a retainer for supporting a mould body insert in extending relationship therefrom;

said mould body insert for association with said partially defined mould cavity, to further define said mould cavity;

said retainer slidably mounted on a support for movement between a first position whereat said insert is substantially removed from said partially defined mould cavity and a second position whereat said insert is within said partially defined mould cavity to further define said mould cavity;

interlocking means comprising a first one of a wedge receptor in said retainer and a slidable wedge supported by said retainer, and a first complementary one of a wedge receptor in said support and a slidable wedge supported by said support; and camming means interconnecting said retainer and said first wedge for extending said first wedge toward and into said first wedge receptor as said retainer is moved from said first position to said second position such that said first wedge engages said first wedge receptor when said retainer is in said second position to lock said retainer in said second position.

2. The apparatus of claim 1, wherein said support defines a channel; and said retainer is slidably mounted within said channel, to allow said retainer to slide within and along said channel to move from said first position to said second position.

3. The apparatus of claim 2 wherein, said means to interlock said retainer to said support further comprises a second one of a wedge receptor in said retainer and a slidable wedge supported by said retainer, substantially opposite said first one of a wedge receptor and wedge, and a second complementary one of a wedge receptor in said support and a slidable wedge supported by said support, substantially opposite said first complementary one of a wedge receptor and wedge;

wherein said second wedge is adapted to engage said second wedge receptor to lock said retainer in said second position and wherein said camming means interconnects said retainer and said second wedge for extending said second wedge toward and into said second wedge receptor as said retainer is moved from said first position to said second position such that said second wedge engages said second wedge receptor when said retainer is in said second position to lock said retainer in said second position.

4. The apparatus of claim 3 wherein said first complementary one of a wedge and wedge receptor comprises a wedge receptor in a first wall of said channel.

5. The apparatus of claim 4 wherein said second complementary one of a wedge and wedge receptor comprises a wedge receptor in a second wall of said channel, opposite said first wall.

6. The apparatus of claim 5 wherein said camming means comprises two cam roller slots in a third wall of said channel, extending between said first wall and said second wall;

said first and second wedges being slidably mounted in a directing passage in said retainer and attached to first and second cam rollers;

and wherein said cam rollers engage said cam roller slots, said cam roller slots configured such that said cam rollers extend said wedges from edges of said retainer toward said wedge receptors as said retainer is moved toward said second position.

7. The apparatus of claim 6 further comprising a link rod and first and second link arms;

wherein said first and second link arms are each rotatably attached at one end to one of said cam rollers and are rotatably attached at a second end to said link rod, wherein said retainer may be moved between said first and second positions and said cam rollers may be pushed along said slots to extend said wedges by pushing said link rod.

8. The apparatus of claim 7, wherein said link rod extends from a linear actuator.

9. The apparatus of claim 1 wherein said mould body insert, when inserted in said partially defined mould cavity completely defines said cavity.

10. A mould apparatus comprising:

a first part for supporting a first mould body portion;

a second part for supporting a second mould body portion said second part moveable toward said first part along a first path such that said first and second mould body portions form a mould body partially defining a mould cavity;

a retainer for supporting a mould body insert in extending relationship therefrom;

said mould body insert for association with said partially defined mould cavity, to further define said mould cavity;

said retainer slidably mounted on a support for movement along a second path between a first position whereat said insert is substantially removed from said partially defined mould cavity and a second position whereat said insert is within said partially defined mould cavity to further define said mould cavity;

interlocking means comprising a first one of a wedge receptor in said retainer and a slidable wedge supported by said retainer, and a first complementary one of a wedge receptor in said support and a slidable wedge supported by said support; and camming means interconnecting said retainer and said first wedge for extending said first wedge toward and into said first wedge receptor as said retainer is moved from said first position to said second position such that said first wedge engages said first wedge receptor when said retainer is in said second position to lock said retainer in said second position.

11. The apparatus of claim 10, wherein said support defines a channel; and said retainer is slidably mounted within said channel, to allow said retainer to slide within and along said channel to move from said first position to said second position.

12. The apparatus of claim 11, wherein, said means to interlock said retainer to said support further comprises a second one of wedge receptor in said retainer and a slidable wedge supported by said retainer, substantially opposite said first one of a wedge receptor and wedge, and a second complementary one of a wedge receptor in said support and a slidable wedge supported by said support, substantially opposite said first complementary one of a wedge receptor and wedge;

wherein said second wedge is adapted to engage said second wedge receptor to lock said retainer in said second position and said camming means interconnects said retainer and said second wedge for extending said second wedge toward and into said second wedge receptor as said retainer is moved from said first position to said second position such that said second wedge engages said second wedge receptor when said retainer is in said second position to lock said retainer in said second position.

13. The apparatus of claim 12 wherein said first complementary one of a wedge and wedge receptor comprises a wedge receptor in a first wall of said channel.

14. The apparatus of claim 13 wherein said second complementary one of a wedge and wedge receptor comprises a wedge receptor in a second wall of said channel, opposite said first wall.

15. The apparatus of claim 14 wherein said camming means comprises two cam roller slots in a third wall of said channel, extending between said first wall and said second wall;

said first and second wedges being slidably mounted in a directing passage in said retainer and attached to first and second cam rollers;

and wherein said cam rollers engage said cam roller slots, said cam roller slots configured such that said cam rollers extend said wedges from edges of said retainer toward said wedge receptors as said retainer is moved toward said second position.

16. The apparatus of claim 15 further comprising a link rod and first and second link arms;

wherein said first and second link arms are each rotatably attached at one end to one of said cam rollers and are rotatably attached at a second end to said link rod, wherein said retainer may be moved between said first and second positions and said cam rollers may be pushed along said slots to extend said wedges by pushing said link rod.

17. The apparatus of claim 16, wherein said link rod extends from a linear actuator.

18. The mould apparatus of claim 10 wherein said first path is a first linear path and said second path is a second linear path.

19. The mould apparatus of claim 18 wherein said first linear path is not parallel to said second linear path.

20. The apparatus of claim 10 wherein said mould body insert, when inserted in said partially defined mould cavity completely defines said cavity.

21. A die cast mould apparatus comprising:

a base for supporting a mould body, said mould body partially defining a mould cavity;

a mould body insert to further define said mould cavity when said mould body insert is inserted in a partially defined mould cavity and locked in a position, said mould body insert mounted on a retainer;

a support extending from said base defining a channel wherein said retainer is locked to said support in said channel by way of interlocking wedges and wedge receptors when said retainer is moved in said channel to further define said mould cavity; and wherein one of said wedges and wedge receptors is on said retainer, and the other one of said wedges and wedge receptors is on walls of said channel.

22. The apparatus of claim 21, wherein said retainer is slidably mounted within said channel.

23. The apparatus of claim 22 wherein said wedges are on said retainer and said wedge receptors are on said walls of said channel.

24. The apparatus of claim 23 wherein said wedges comprise a first and second wedge slidably mounted in a directing passage within said retainer and extendible from opposing edges of said retainer;

and said apparatus further comprises a third wall of said channel, on said support, extending between said walls having said wedge receptors;

first and second cam roller slots in said third wall;

first and second cam rollers attached to said first and second wedges;

and wherein said cam rollers engage said cam roller slots, said cam roller slots configured such that said cam rollers extend said wedges from opposite edges of said retainer toward said wedge receptors as said retainer is moved in said channel to further define said mould cavity.

25. The apparatus of claim 24 further comprising a link rod;

a first link arm rotatably attached at one end to said first cam roller and at a second end to said link rod;

a second link arm rotatably attached at one end to said second cam roller and at a second end to said link rod;

wherein said retainer may be moved within said channel to insert said insert in said partially defined mould cavity and said cam rollers may be pushed along said slots to extend said wedges, by pushing said link rod.

26. The apparatus of claim 25, wherein said link rod extends from a linear actuator.

27. The apparatus of claim 21 wherein said mould body insert, when inserted in said partially defined mould cavity completely defines said cavity.

* * * * *